US007329085B2

(12) United States Patent
Walker et al.

(10) Patent No.: US 7,329,085 B2
(45) Date of Patent: Feb. 12, 2008

(54) PUMP IMPELLER

(75) Inventors: Craig Ian Walker, Frenchs Forest (AU); Anton Watermann, Bedfordale, WA (US)

(73) Assignee: Weir Minerals Australia Ltd. (AU)

( * ) Notice: Subject to any disclaimer, the term of this patent is extended or adjusted under 35 U.S.C. 154(b) by 0 days.

(21) Appl. No.: 10/560,463

(22) PCT Filed: Jun. 15, 2004

(86) PCT No.: PCT/AU2004/000784

§ 371 (c)(1),
(2), (4) Date: Dec. 14, 2005

(87) PCT Pub. No.: WO2004/111463

PCT Pub. Date: Dec. 23, 2004

(65) Prior Publication Data

US 2006/0127211 A1 Jun. 15, 2006

(30) Foreign Application Priority Data

Jun. 16, 2003 (AU) ..... 2003903024

(51) Int. Cl.
*F01D 1/08* (2006.01)
*F04D 29/18* (2006.01)

(52) U.S. Cl. ..... 415/87; 415/97; 415/172.1; 415/173.1

(58) Field of Classification Search ..... 415/74, 415/86, 87, 97, 121.2, 121.1, 171.1, 172.1, 415/173.1; 416/181
See application file for complete search history.

(56) References Cited

U.S. PATENT DOCUMENTS

| | | | | |
|---|---|---|---|---|
| 1,879,803 | A * | 9/1932 | Johnson | 415/144 |
| 1,881,723 | A * | 10/1932 | Lee | 415/119 |
| 3,190,226 | A | 6/1965 | Judd | |
| 3,384,026 | A | 5/1968 | Williamson, Jr. | |
| 3,663,117 | A | 5/1972 | Warren | |
| 4,664,592 | A | 5/1987 | Grzina | |
| 4,883,403 | A | 11/1989 | Walker | |
| 5,165,858 | A | 11/1992 | Gilbert et al. | |
| 5,489,187 | A | 2/1996 | Ray | |
| 5,921,748 | A | 7/1999 | Frater | |
| 6,036,434 | A | 3/2000 | Ray et al. | |

FOREIGN PATENT DOCUMENTS

| | | |
|---|---|---|
| EP | 567 123 A1 | 10/1993 |
| GB | 930 474 A | 7/1963 |
| SU | 1064047 A2 | 12/1983 |

* cited by examiner

*Primary Examiner*—Edward K. Look
*Assistant Examiner*—Dwayne J White
(74) *Attorney, Agent, or Firm*—Morris O'Bryant Compagni

(57) ABSTRACT

An impeller for use in a centrifugal pump, the impeller including a shroud having opposed faces, an outer peripheral edge portion and a rotation axis, a plurality of pumping vanes on one of the faces of the shroud and extending away from the rotation axis, each pumping vane having an outer peripheral edge portion, and a plurality of auxiliary vanes on the other face of the shroud, the auxiliary vanes of each having an outer edge portion wherein the dimension Da from the rotation axis to the outer peripheral edge portion of the shroud is greater than the dimension Db from the rotation axis to the outer edge portion of the auxiliary vanes.

20 Claims, 8 Drawing Sheets

PUMP IMPELLER

TECHNICAL FIELD

The present invention relates to impellers and more particularly to impellers suitable for use in centrifugal pumps.

Centrifugal pumps are commonly used to handle liquid mixtures of particulate solids in the mineral processing and dredging industries. Those pumps are subject to severe slurry erosion wear by the particles in the flow which leads to considerable economic consequence to such operations. Considerable effort is expended by manufacturers and users to try to ameliorate this problem.

Such centrifugal pumps include a pump housing with a pump chamber therein and an impeller disposed within the pump chamber for rotation about a rotation axis. The impeller is operatively connected at one side to a drive shaft, there being an inlet on the other side thereof. The impeller includes a hub to which the drive shaft is connected and at least one shroud. A plurality of pumping vanes are on one side of the shroud. Often two shrouds are provided with the pumping vanes therebetween. The shroud adjacent the inlet is commonly referred to as the front shroud and the other shroud is referred to as the back shroud.

Centrifugal pumps, particularly those used for transporting slurries, commonly use so called "expelling" vanes or auxiliary vanes on the back and front shrouds of the pump's impeller to help rotate the fluid in the space between the shroud and the side liner. Those auxiliary vanes may be of different shapes depending on the preferences of the individual designer.

By spinning the fluid in the space between the impeller and the side liner, the static pressure at the inlet of the impeller is reduced due to the centrifugal flow induced (vortex effect), such that fluid between the auxiliary vanes will flow towards the impeller periphery. Fluid returns down the face of the side liner due to the overall driving pressure difference between that at the impeller discharge and inlet. Particles in the flow may also be purged from the gap if the centrifugal force is greater than the fluid drag force tending to carry the particles into the gap.

The major purpose of the auxiliary vanes on the front shroud of the impeller is to reduce the driving pressure forcing the flow from the volute back into the eye of the impeller (recirculating flow). By reducing the recirculating flow velocity, the wear on the impeller and the mating inlet side liner is considerably reduced.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

BACKGROUND ART

There are a number of different shapes of auxiliary vane that have been developed and used in existing impellers.

In one example, shown in U.S. Pat. No. 4,664,592, and the contents of which are incorporated here by reference, a number of radial auxiliary vanes are used. Those auxiliary vanes are located on the face of the front or back shroud, with an annular projection around the outer ends of the auxiliary vanes, and with a channel extending through the annular projection between adjacent auxiliary vanes.

A problem with the auxiliary vanes, with or without annular projections at the periphery, is that tip vortices form (similar to wingtip vortices) which, when particles are entrained, can cause severe localised gouging wear of the periphery of the impeller and the adjacent side liners.

As the parts wear, the vortex which forms behind each projecting vane gets larger and stronger causing an ever increasing wear rate in the adjacent side liner.

Water pumps are known which include auxiliary vanes at a smaller diameter than the shroud and main vane diameter (which are usually identical). The reason this is done is not to reduce wear, but to reduce the axial hydraulic thrust acting on the impeller. The auxiliary vane diameter is sized to balance the hydraulic axial thrust.

DISCLOSURE OF INVENTION

According to one aspect of the present invention there is provided an impeller suitable for use in a centrifugal pump, the impeller including a shroud having opposed faces, an outer peripheral edge portion and a rotation axis, a plurality of pumping vanes on one of the faces of the shroud and extending away from the rotation axis, each pumping vane having an outer peripheral edge portion, and a plurality of auxiliary vanes on the other face of the shroud, the auxiliary vanes each having an outer edge portion wherein the dimension Da from the rotation axis to the outer peripheral edge portion of the shroud is greater than the dimension Db from the rotation axis to the outer edge portion of the auxiliary vanes.

In one preferred form, the impeller includes two shrouds, (a front shroud and a back shroud) with the pumping vanes therebetween and auxiliary vanes on one or both of the shrouds. In one embodiment the front shroud extends beyond the diameter of the auxiliary and main pumping vanes. In another embodiment the back shroud extends beyond the diameter of the auxiliary and main pumping vanes. In yet another arrangement both the front and back shrouds extend beyond the diameter of the auxiliary and pumping vanes. Preferably, the diameters of the pumping vanes and auxiliary vanes are about the same diameter for example within about 5% of each other.

Preferably, the pumping and auxiliary vanes are of a similar diameter to ensure adequate pressure reduction and reduced recirculating flow while the impeller shroud extends beyond both so as to ameliorate wear.

The benefit of the extended shroud impeller arrangement is that the tip vortex from each auxiliary vane is shed against the face of the extended shroud and is trapped within the gap or space between the shroud and the adjacent side liner. By this construction the wear on the impeller and the liner is substantially reduced. The beneficial affect appears to derive from not allowing full formation of the tip vortices by means of the present invention.

Further, in one embodiment of the present invention there is provided an impeller with a shroud of diameter Da and a plurality of predominantly radial auxiliary vanes on the face of the front shroud with a diameter Db, the radially outermost end of the vane tapers back relative to the shroud at an angle Z. The shroud, side liner and auxiliary vane wear has been found to be particularly reduced when Db is less than 0.95 Da and more preferably from 0.65 to 0.95 Da and more preferably less than 0.9 Da. This appears to be due to there being sufficient space between the tip of the auxiliary vane and the shroud periphery to trap the trailing vortices. The diameter Db is preferably approximately the same as the diameter of the main pumping vane. This relationship ensures that the pressure reducing capability of the auxiliary vanes is not significantly impaired when compared to the pressure generated by the main pumping vanes.

BRIEF DESCRIPTION OF DRAWINGS

Preferred embodiments of the present invention will now be described by way of example with reference to the accompanying drawings, in which.

BEST MODES

Figure 1:
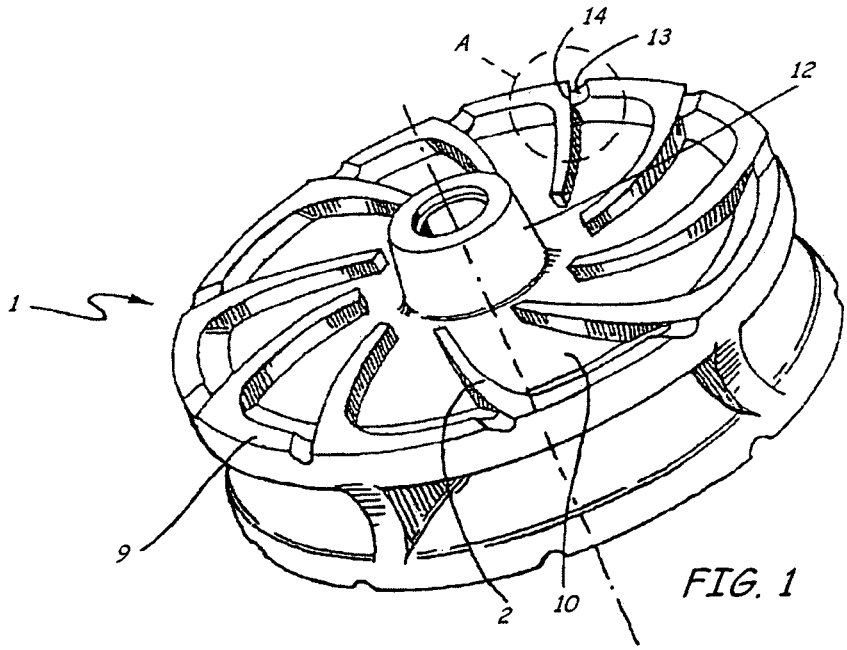
FIG. 1 (PRIOR ART)
FIG. 1 is a perspective view of a prior art impeller as shown by FIG. 1 of U.S. Pat. No. 4,664,592.

The prior art impeller 1 of FIG. 1 is fully described in U.S. Pat. No. 4,664,592 and it will be understood by reference to that specification.

Figure 2:
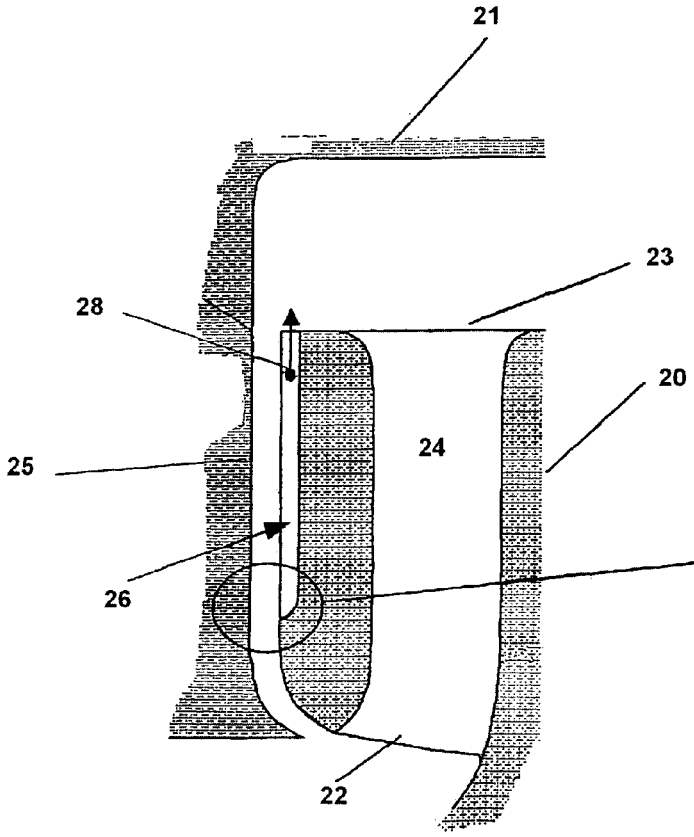
FIGURE 2 (PRIOR ART)
FIG. 2 is a partial sectional view of a conventional impeller and expeller or auxiliary vane of a centrifugal pump.

As shown in FIG. 2 an impeller 20 is housed in casing liner 21. Slurry travels through impeller 20 from inlet 22 to outlet 23 of each pumping chamber 24 as the impeller rotates within casing liner 21. A recirculating flow of slurry from outlet 23 to inlet 22 occurs naturally and causes abrasive wear of the inlet side liner 25. Expelling or auxiliary vane 26 acts to move the recirculating slurry 27 back toward the impeller outlet as represented by particles 28. The slurry flow path between impeller 20 and liner 25 is shown in more detail by FIG. 3.

Figure 4:
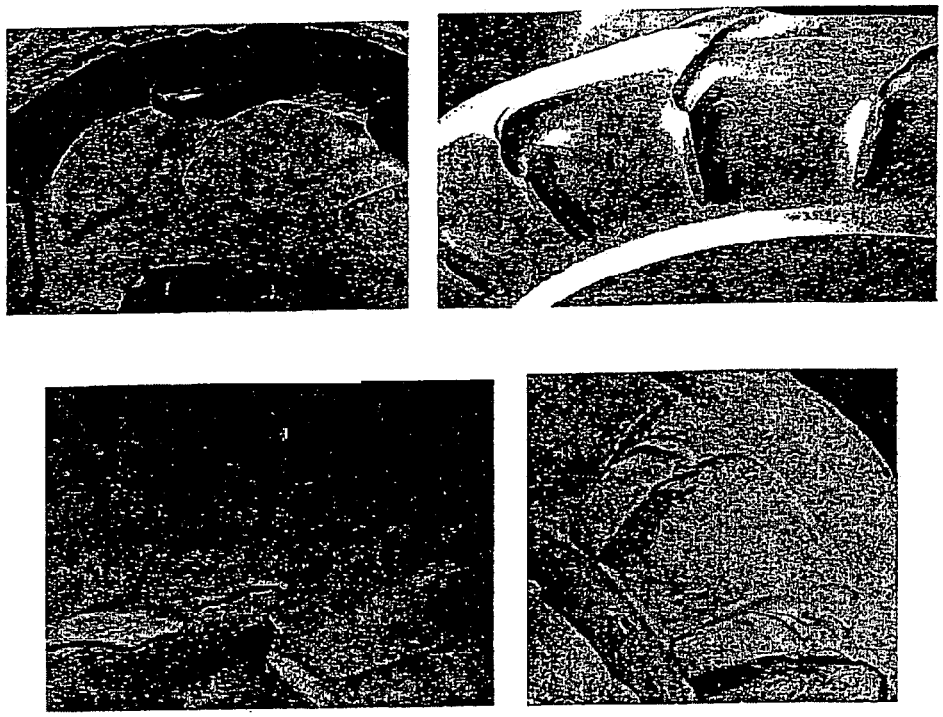
FIGURE 4 (PRIOR ART)
FIG. 4 shows a series of photographs of wear profiles on typical expelling vanes.

The wear profiles of the auxiliary vanes apparent in the photographs of FIG. 4 are demonstrative of the problem confronted by industry and to be ameliorated by application of embodiments of the present invention.

Figure 3:
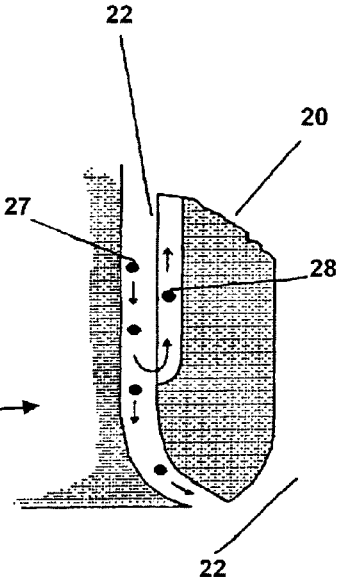
FIGURE 3 (PRIOR ART)
FIG. 3 is a magnification of the circled portion of FIG. 2 showing the slurry flow paths between an auxiliary vane and casing liner.
Figure 5:
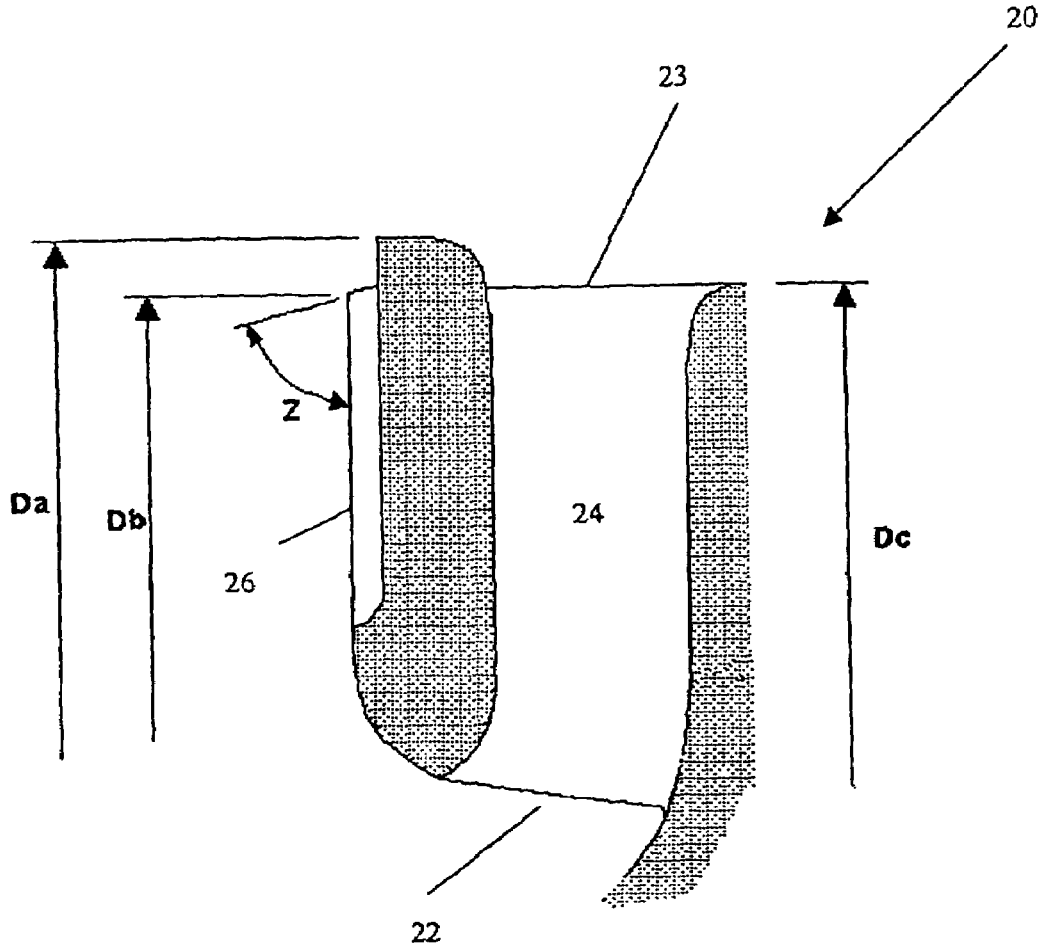
FIG. 5 is a part sectional view similar to FIG. 2 but showing an embodiment of an impeller in accordance with the present invention.

FIG. 5 includes the same reference numerals for like parts as those designated in FIGS. 2 and 3. In this embodiment of the present invention the auxiliary vanes are straight, with a diameter to the point shown on auxiliary vane 26 of Db=0.85 Da, wherein Da is the shroud diameter, and where angle Z=45°. The diameter of Db is approximately equal to the diameter of main pumping vane denoted as Dc in FIG. 5.

Testing of this embodiment of the present invention and comparing its results with a prior art example of the kind shown by FIG. 4 exhibits much reduced wear at the vane tips and on the adjacent side liner for approximately the same operating time.

Figure 6:
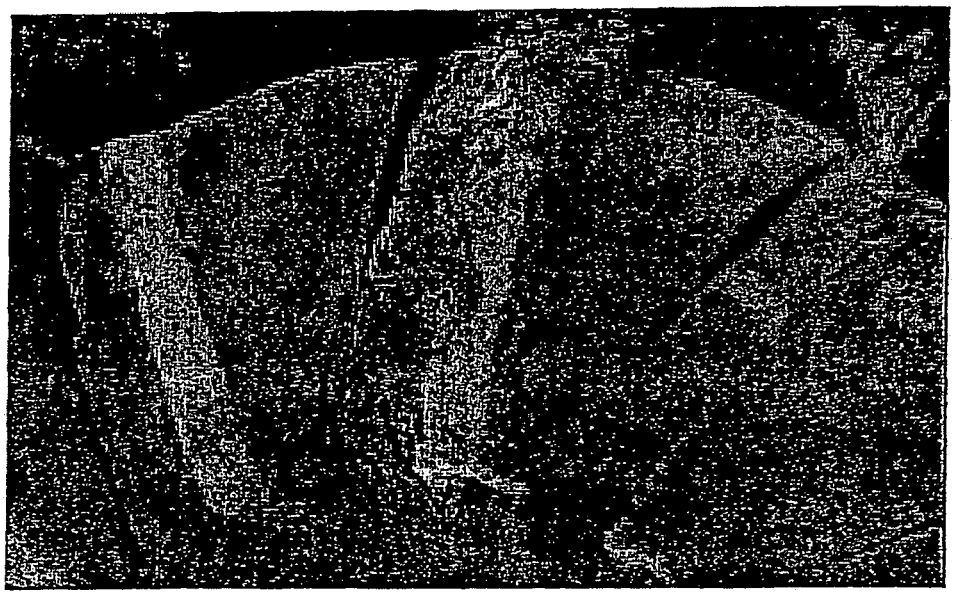
FIGURE 6 (PRIOR ART)
FIG. 6 is a photograph showing the wear profile of auxiliary vanes of a prior art impeller.

As can be seen in the photograph of FIG. 6, the wear on the auxiliary vanes of these known impellers is extensive.

Figure 7:
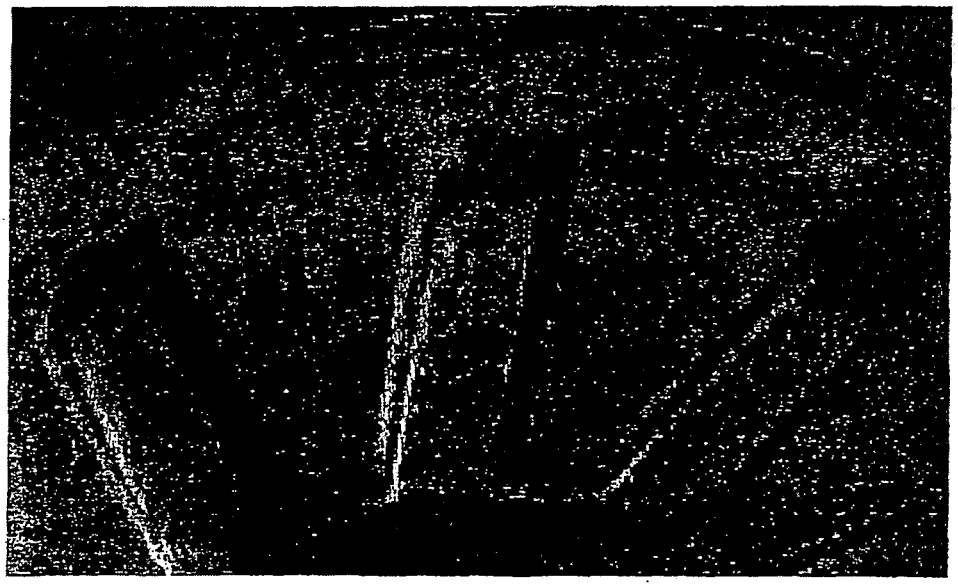
FIG. 7 is a photograph showing the wear profile of auxiliary vanes on an impeller in accordance with an embodiment of the present invention.

By contrast, the auxiliary vanes on the impeller of FIG. 7 are in considerably better condition than those shown in FIG. 6, despite having been under operation in a similar environment and for a similar period of time.

Figure 8:
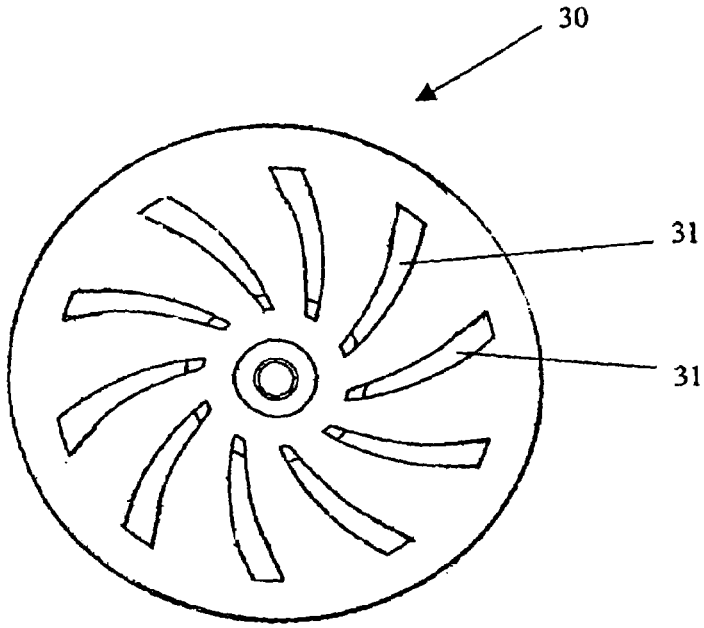
FIG. 8 is an axial or end view of a further embodiment of an impeller in accordance with the present invention.

The impeller embodiment 30 of FIG. 8 is formed with auxiliary vanes 31 having curved leading and trailing edges instead of straight as for the embodiments of FIGS. 5 and 7. The corresponding prior art arrangement is shown in FIG. 6. Again, this embodiment of the present invention shows much reduced wear at the vane tips when compared with its prior art equivalent for similar operating times.

Figure 9:
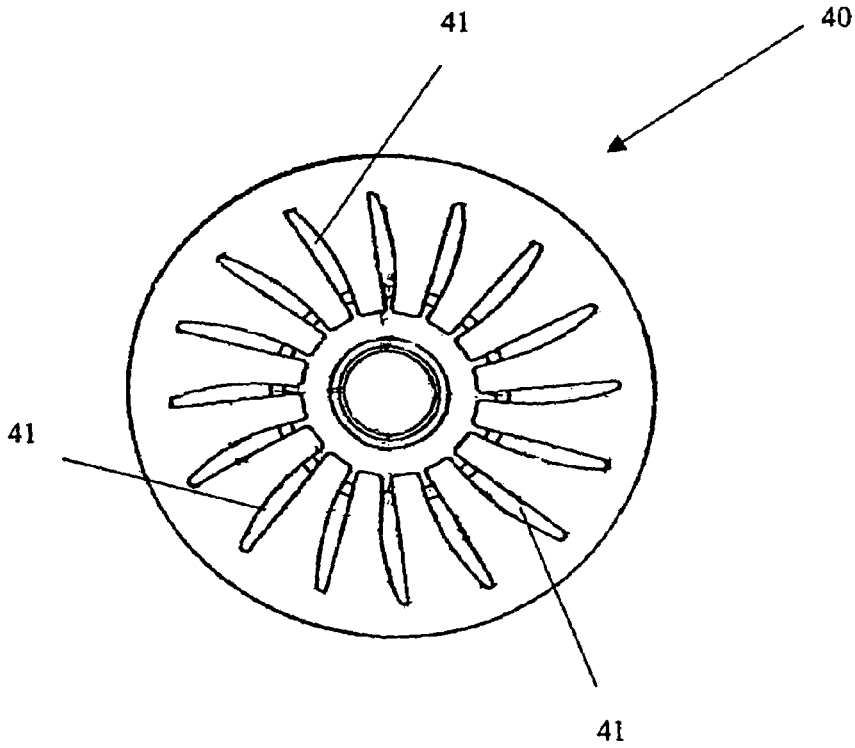
FIG. 9 is an axial or end view of yet another embodiment of an impeller in accordance with the present invention.

The embodiment of FIG. 9 shows yet another variation of profile for the auxiliary vanes 41 of the impeller 40.

Figure 10:
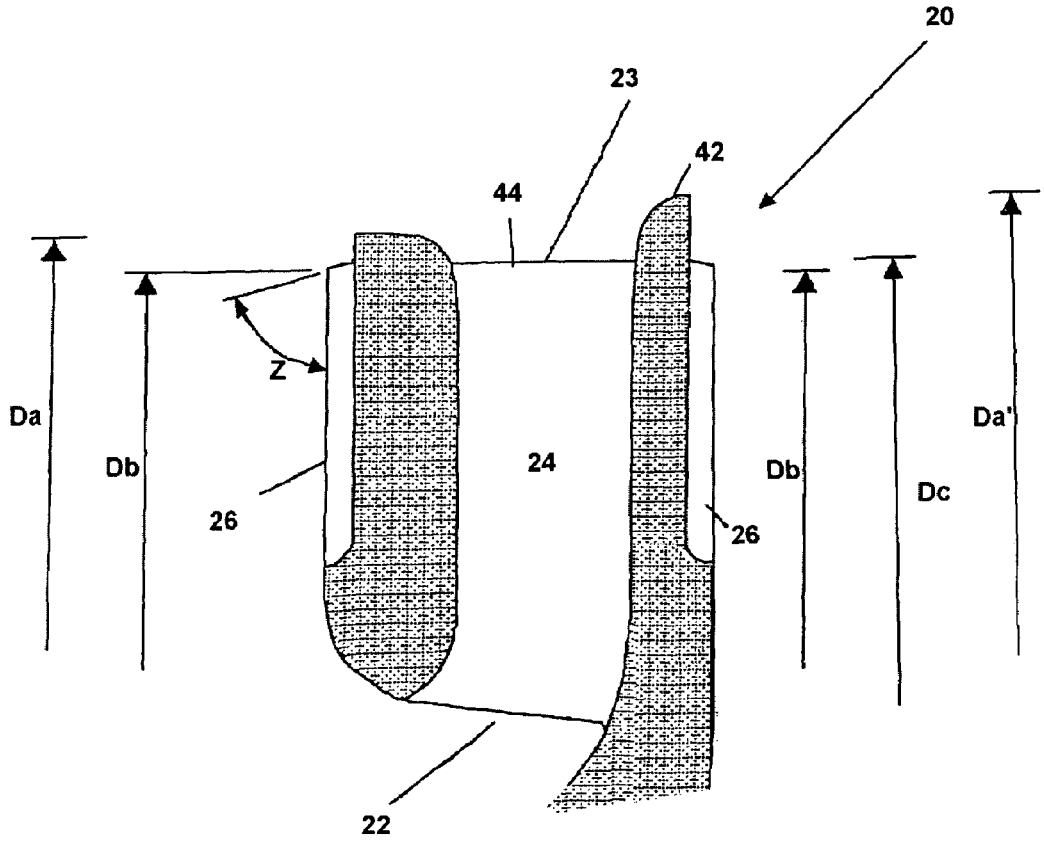
FIG. 10 is a partial sectional view of an impeller illustrating an alternative embodiment of the present invention.

FIG. 10 illustrates an alternative embodiment of the invention where the impeller 20 has a back shroud 42 that has a diameter Da' as defined by the distance from the rotation axis to the outer peripheral edge portion of the shroud, and where the diameter Da' is greater than the diameter Db of the auxiliary vanes 26 and greater than the diameter Dc of the pumping vanes 44.

Figure 11:
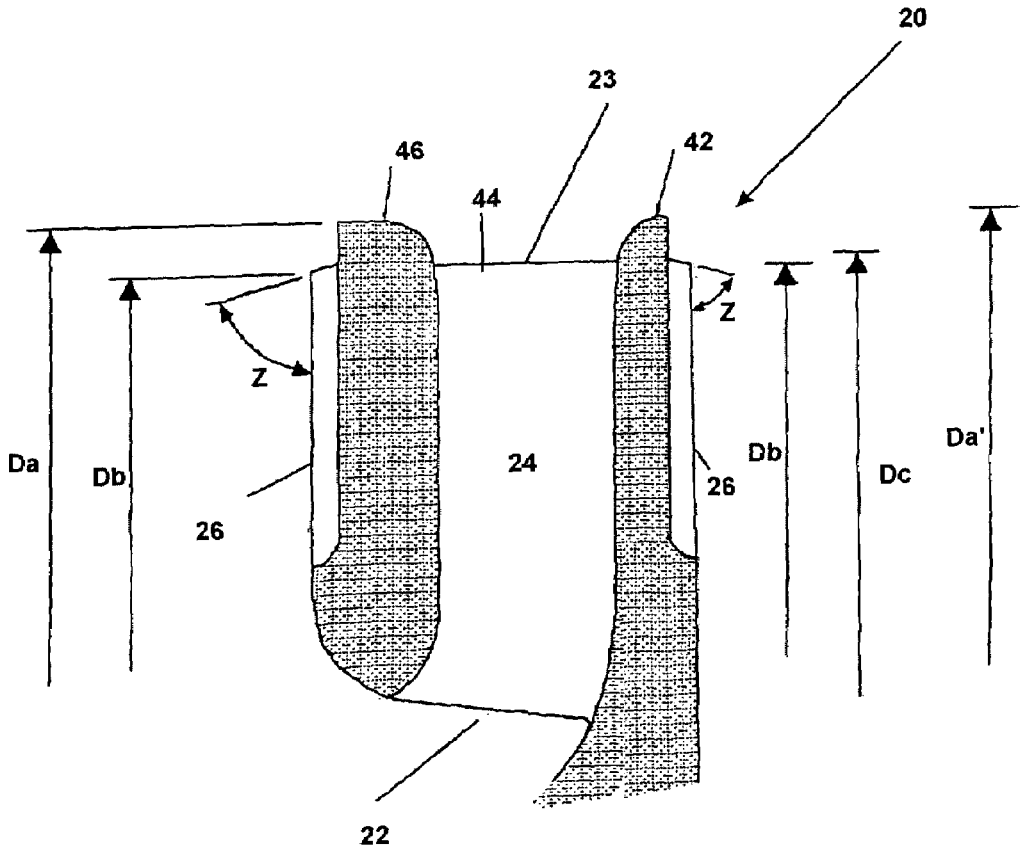
FIG. 11 is a partial sectional view of an impeller illustrating another alternative embodiment of the present invention.

FIG. 11 illustrates another alternative embodiment of the invention where the impeller 20 has a front shroud 46 and a back shroud 42, both of which have a diameter Da and Da', respectively and each has auxiliary vanes 26 having an angled outer edge portion where the angle Z=45°. The diameters Da and Da' of the front and back shrouds respectively are greater than the diameter Db of the auxiliary vanes 26 or the diameter Dc of the pumping vanes 44.

Finally, it is to be understood that various alterations, modifications and/or additions may be incorporated into the various constructions and arrangements of parts without departing from the spirit or ambit of the invention.

The invention claimed is:

1. An impeller suitable for use in a centrifugal pump, for handling liquid mixtures containing particulate solids, the impeller including a front shroud having opposed faces, an outer peripheral edge portion and a rotation axis, a back shroud having opposed faces, an outer peripheral edge portion and a rotation axis, a plurality of pumping vanes positioned between the front and back shroud and extending away from the rotation axis, each pumping vane having an outer peripheral edge portion, and a plurality of auxiliary vanes on the other face of at least one shroud, the auxiliary vanes each having an outer edge portion, wherein the dimension Da from the rotation axis to the outer peripheral edge portion of the shrouds is greater than the dimension Db from the rotation axis to the outer edge portion of the auxiliary vanes and wherein Da is greater than the dimension Dc from the rotation axis to the outer peripheral edge portion of the pumping vanes and wherein the dimension Da of the one of the shrouds is greater than the dimension Da of the other shroud.

2. An impeller according to claim 1 wherein the auxiliary vanes are located on the other face of one of the shrouds.

3. An impeller according to claim 1 wherein the impeller further comprises auxiliary vanes being positioned on the other face of each of the front shroud and back shroud.

4. An impeller according to claim 1 wherein the dimension Da of the front shroud is greater than the dimension Da' of the back shroud.

5. An impeller according to claim 1 wherein the dimension Da' of the back shroud is greater than the dimension Da of the front shroud.

6. An impeller according to claim 1 wherein Db and Dc are substantially the same.

7. An impeller according to claim 1 wherein Db and Dc are within 5% of each other.

8. An impeller according to claim 1 wherein Db is less than 0.95 Da.

9. An impeller according to claim 8 wherein Db/Da is from 0.65 to 0.95.

10. An impeller according to claim 8 wherein Db/Da is from 0.65 to 0.9.

11. An impeller suitable for use in a centrifugal pump, for handling liquid mixtures containing particulate solids, the impeller including at least one shroud having opposed faces, an outer peripheral edge portion and a rotation axis, a plurality of pumping vanes on one of the faces of said at least one shroud extending away from the rotation axis, each pumping vane having an outer peripheral edge portion, and a plurality of auxiliary vanes on the other opposing face of said at least one shroud, the auxiliary vanes each having an outer edge extending axially from said other opposing face of said at least one shroud that is oriented at an angle Z to a line parallel to the rotation axis and angled downwardly from said opposing face of said at least one shroud toward said rotational axis, and wherein the dimension Da defined by the distance from the rotation axis to the outer peripheral edge portion of said at least one shroud is greater than the dimension Db defined by the distance from the rotation axis to the outer edge of the auxiliary vanes, and wherein Da is greater than the dimension Dc defined by the distance from the rotation axis to the outer peripheral edge portion of the pumping vanes.

12. The impeller of claim 11 wherein said angle Z of said outer edge of said auxiliary vanes is about 45°.

13. The impeller of claim 11 wherein said at least one shroud further comprises a front shroud and a back shroud.

14. The impeller of claim 13 further comprising auxiliary vanes on both said front shroud and said back shroud.

15. The impeller of claim 13 wherein said front shroud has a diameter Da and said back shroud has a diameter Da', and the dimension Da is greater than Da'.

16. The impeller of claim 13 wherein said front shroud has a diameter Da and said back shroud has a diameter Da', and the dimension Da' is greater than Da.

17. The impeller of claim 13 wherein said front shroud has a diameter Da and said back shroud has a diameter Da', and the dimensions of Da and Da' are both greater than the dimension Db.

18. The impeller of claim 11 wherein the dimension Db is approximately the same as the dimension Dc.

19. The impeller of claim 11 wherein the dimension Db is within 5% of the dimension Dc.

20. The impeller of claim 11 wherein said dimension Db is between 65% to 95% of the dimension Da of said at least one shroud.

* * * * *